US006483058B2

(12) United States Patent
Ehrensberger

(10) Patent No.: US 6,483,058 B2
(45) Date of Patent: Nov. 19, 2002

(54) SEALED MANUAL RESET SWITCH

(75) Inventor: Robert Ehrensberger, Imperial, PA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/949,307

(22) Filed: Sep. 7, 2001

(65) Prior Publication Data

US 2002/0033323 A1 Mar. 21, 2002

Related U.S. Application Data

(60) Provisional application No. 60/230,751, filed on Sep. 7, 2000.

(51) Int. Cl.[7] ..... H01H 9/04; H01H 13/06; H01H 13/36

(52) U.S. Cl. ..... 200/302.2; 200/43.04; 200/447; 200/530; 200/537; 200/334

(58) Field of Search ..... 200/43.01, 43.04, 200/43.07, 520, 530, 532, 534, 535, 537, 538, 447, 243, 302.1, 302.2, 329, 334, 405, 448, 449, 341

(56) References Cited

U.S. PATENT DOCUMENTS

| | | | | | |
|---|---|---|---|---|---|
| 1,011,754 | A | | 12/1911 | Cubitt | |
| 2,236,680 | A | | 4/1941 | Fry | 200/47 |
| 2,476,056 | A | | 7/1949 | Martin | 200/76 |
| 2,519,297 | A | | 8/1950 | Stump, Jr. et al. | 200/116 |
| 2,526,850 | A | | 10/1950 | Charbonneau | 200/76 |
| 2,598,856 | A | | 6/1952 | Swan et al. | 200/76 |
| 2,629,791 | A | | 2/1953 | Le Tourneau | 200/76 |
| 2,748,229 | A | | 5/1956 | Block | 200/169 |
| 2,750,463 | A | | 6/1956 | Roeser | 200/67 |
| 2,785,251 | A | | 3/1957 | Cassidy | 200/138 |
| 3,017,471 | A | | 1/1962 | Karch | 200/76 |
| 3,144,530 | A | | 8/1964 | Bily et al. | 200/76 |
| 3,566,057 | A | | 2/1971 | Reinke | 200/76 |
| 3,588,423 | A | | 6/1971 | Hallerberg | |
| 3,612,793 | A | * | 10/1971 | Roeser | 200/313 |
| 3,769,481 | A | * | 10/1973 | Raab | 200/295 |
| 3,862,389 | A | | 1/1975 | Lowe | 200/302 |
| 4,121,070 | A | | 10/1978 | Silbernagel | 20/67 |
| 4,602,137 | A | | 7/1986 | Kawasaki | 200/76 |
| 4,650,936 | A | * | 3/1987 | Lupoli et al. | 200/296 |
| 4,698,466 | A | * | 10/1987 | Beck et al. | 200/308 |
| 4,897,516 | A | * | 1/1990 | Wakatsuki | 200/17 R |
| 5,047,628 | A | * | 9/1991 | Schmidt et al. | 200/296 |
| 5,055,643 | A | * | 10/1991 | Pardini et al. | 200/16 R |
| 5,389,758 | A | | 2/1995 | Agnatovech | 200/530 |
| 5,550,342 | A | | 8/1996 | Danek et al. | 200/448 |
| 5,671,841 | A | | 9/1997 | Glasson | 200/406 |

* cited by examiner

*Primary Examiner*—Michael Friedhofer
(74) *Attorney, Agent, or Firm*—Pearson & Pearson, LLP

(57) ABSTRACT

A double pole, manual reset switch that is sealed from its application environment. The switch comprises a shell and a base assembly including an actuator, terminals and blade/contacts. After the switch actuator is depressed to a "make" position, it must be manually lifted back to a "break" position. The switch has an epoxy seal along the bottom between the shell and base, heat shrink material around an opening where wires pass through, and an O-ring on the actuator for sealing the top of the switch. The components of the switch are easily assembled in the base prior to insertion of the base assembly into the shell. The wires extend from the switch adjacent to each other at an end, and in an alternate embodiment of the switch, the wires extend in pairs from a rear side of the switch.

20 Claims, 15 Drawing Sheets

SEALED MANUAL RESET SWITCH

BACKGROUND OF THE INVENTION

This is a nonprovisional patent application claiming priority of provisional patent application Ser. No. 60/230,751, filed Sep. 7, 2000.

Field of the Invention

This invention relates to an electric switch and in particular to a sealed double pole switch which requires the actuator to be manually lifted back to a reset position.

Description of Related Art

There are many types of electrical applications requiring different features in a switch that must quickly change from one state to another, and often the switches that are available fail to meet a particular important application criteria. There are snap-acting switches, double pole switches, toggle switches, momentary pushbutton switches, switches that are sealed from the application environment, normally "open" switches and normally "closed" switches.

An application of an electrical switch where human safety is top priority created the need for an improved switch that is miniature, double pole, fixed position, internally sealed, difficult to reset unless a tool is used, has minimal travel of activate button, very reliable and tamperproof.

Examples of sealed switches and snap-action switches include U.S. Pat. No. 2,748,229 entitled "Water Tight Switch" and issued May 29, 1956 to E. H. Block discloses a cam operated water tight switch operated by depressing a plunger. In order to insure a water tight connection between casing and wall, a ring of solder is heat sealed in groove in casing. The switch comprises the plunger having a pushbutton slidably mounted in bore. An O-ring gasket is mounted in a groove of the plunger for preventing ingress of water to the interior of switch casing. The plunger has a threaded extension and a tubular member and a hollow cylindrical plug. A pair of micro switches having operating pins are operated by spring arms 48 extending from member having a cam surface when the plunger is moved inwardly. A spring returns the tubular member to the initial position and springs are released by cam surfaces.

U.S. Pat. No. 2,519,297 entitled "Circuit Breaker" and issued Aug. 15, 1950 to Clare A. Stump, Jr. et al. discloses a circuit breaker of the snap-acting type. The circuit breaker comprises a pair of resilient switch members having movable contact members secured to the ends thereof. The movable contacts on the switch member are adapted to cooperate with stationary contacts on the inner ends of conductors which extend in opposite directions to the exterior of the casing where they form terminal connectors. An operating rod is manually pushed or pulled to close or open the circuit breaker, and a trip device automatically opens the circuit breaker in response to overload currents. In order to reset and relatch the trip device and the actuating plunger, the pushbutton is pulled out to its extreme outward position.

U.S. Pat. No. 2,750,463 entitled "Electric Switches of the Snap-Action Type" and issued Jun. 12, 1956 to J. O. Roeser discloses an electric snap-action switch having a double-pole double-throw action, the double-throw being simultaneous. The switch comprises two sections arranged superimposed and connected to each other and to a mounting plate. Each section comprises terminal arms having stationary contacts on interior end portions, a spring plate having contacts on each end for contacting contacts, and a plunger having a stem attached to an actuator button. The plunger is provided with a socket into which partially extends an actuating stem in an upper section having a lower end attached to intermediate plunger which in turn is connected to the actuating stem which moves the spring plate in the lower switch section. The movement of the contacts provides a "make before break" switch.

The present invention comprises a novel combination and arrangement of parts to be hereinafter described and claimed.

SUMMARY OF THE INVENTION

Accordingly, it is therefore an object of this invention to provide an electric switch that is double poled, and requires an actuator to be manually lifted back to an unactuated or "break" position with a tool.

It is another object of this invention to provide a doubled pole switch that is internally sealed including use of an O-ring for sealing the actuator at the top of the switch assembly.

It is a further object of this invention to provide an actuator that is depressed to a "make" position and manually lifted back to a "break" position.

It is another object of this invention to provide four terminals in a base along with an actuator and blade/contact assemblies wherein wires are attached to the terminals and routed to exit the base from the same bottom channel.

These and other objects are accomplished by a double pole switch requiring use of a tool for resetting the switch comprising a housing having a plurality of pedestals for supporting a first pair of terminals positioned opposite each other and a second pair of terminals positioned opposite each other and spaced apart from the first pair of terminals, an actuator positioned in an opening of the housing between the first pair of terminals and the second pair of terminals, the actuator having at least two pair of notches spaced apart from each other, a first blade having contacts at opposite ends and a portion of the first blade in contact with an upper pair of the spaced apart notches of the actuator, the actuator passing through the first blade wherein the first blade is positioned to make electrical contact with the first pair of terminals when the switch is in a "make" position, and a second blade having contacts at opposite ends and a portion of the second blade in contact with a lower pair of the spaced apart notches of the actuator, the actuator passing through the second blade wherein the second blade is positioned to make electrical contact with the second pair of terminals when the switch is in a "make" position. The housing comprises a base having a channel for wires to pass through and an outer shell for enclosing the base and receiving an upper portion of the actuator which extends above the shell when the switch is in a "break" position. The first pair of terminals are U-shaped for fitting around a pair of the opposite pedestals formed in the base. Each of the terminals of the first pair and the second pair comprises a wire electrically connected thereto and extending outside of the switch. An upper portion of the actuator comprises a groove around the circumference of the actuator for receiving an O-ring thereby sealing the upper portion of the switch when the base is inserted within an outer shell. The switch comprises means for sealing an opening between a lower portion of the base and the outer shell. The switch comprises heat/shrink material around the base and wires passing through the base. The top portion of the actuator comprises a slot for insertion of the tool for moving the actuator from the "make" position to a "break" position. The top portion of an outer shell of the switch comprises an opening to enable insertion of the tool into the slot of the actuator. The portion of the first blade in contact with an upper pair of spaced apart notches of the actuator comprises a pair of tongues. The portion of the second blade in contact with a lower pair of the spaced apart notches of the actuator comprises a pair of tongues. The base comprises an open channel for receiving each wire from the terminals protruding a predetermined distance from the bottom of the base, the open channel further comprises a lip around the end of the open channel. The switch comprises heat shrink material for sealing off any openings at the lip of the channel.

The object are further accomplished by a sealed, manual reset, double pole switch comprising a housing having a base portion and an outer shell portion, a pair of spaced apart parallel blades positioned within the base having contacts on opposite ends and an actuator positioned through the parallel blades and perpendicular thereto, at least four terminals mounted on pedestals within the base portion, the terminals making electrical contact with the blade contacts when the switch is in a "make" position and the actuator extends above a top portion of the outer shell, the actuator comprises a groove around the circumference of the actuator for receiving an O-ring thereby sealing the upper portion of the switch, the switch comprises means for sealing an opening between a lower portion of the base and the outer shell, the base comprises a channel for wires to pass through and connect to the terminals and heat shrink material applied around an end of the channel and around the wires, and a slot provided in the top portion of the outer shell and the actuator for insertion of a tool to move the actuator from the "make" position to a "break" position to accomplish a reset of the switch.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
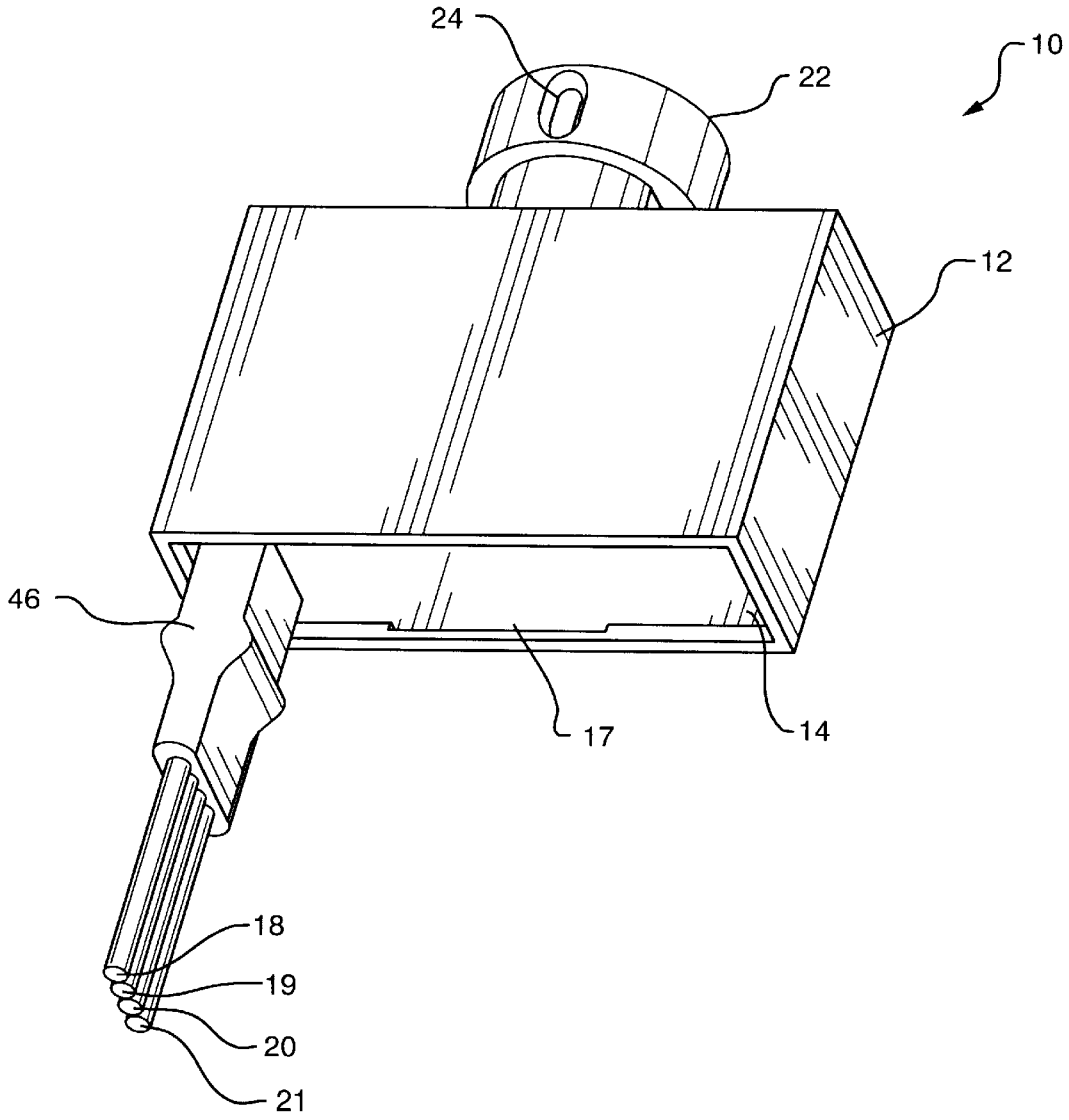
FIG. 1 is a perspective view of the invention showing a reset slot at the top of an outer shell for manually resetting the switch and showing wires extending from a channel on the bottom of the switch.

Referring to FIG. 1, a perspective view of the invention is shown of a double pole, electric switch 10 that is internally sealed and manually reset from a "make" to a "break" position with a tool. The switch 10 comprises a shell 12, a base assembly 14, an extended wire support channel 16, having a protruding lip 23, wires 18–21, an actuator cap 22 formed on top of the shell 12 surrounding the upper portion of an actuator 26, and a slot 24 for receiving a tool (not shown) to reset the switch 10. The tool may be any rigid device that can move the actuator 26 and cause the switch 10 to go from the "make" to the "break"position, such as a stiff metal hook or L-shaped device such as a small allen wrench that fits into slot 24.

Figure 2:
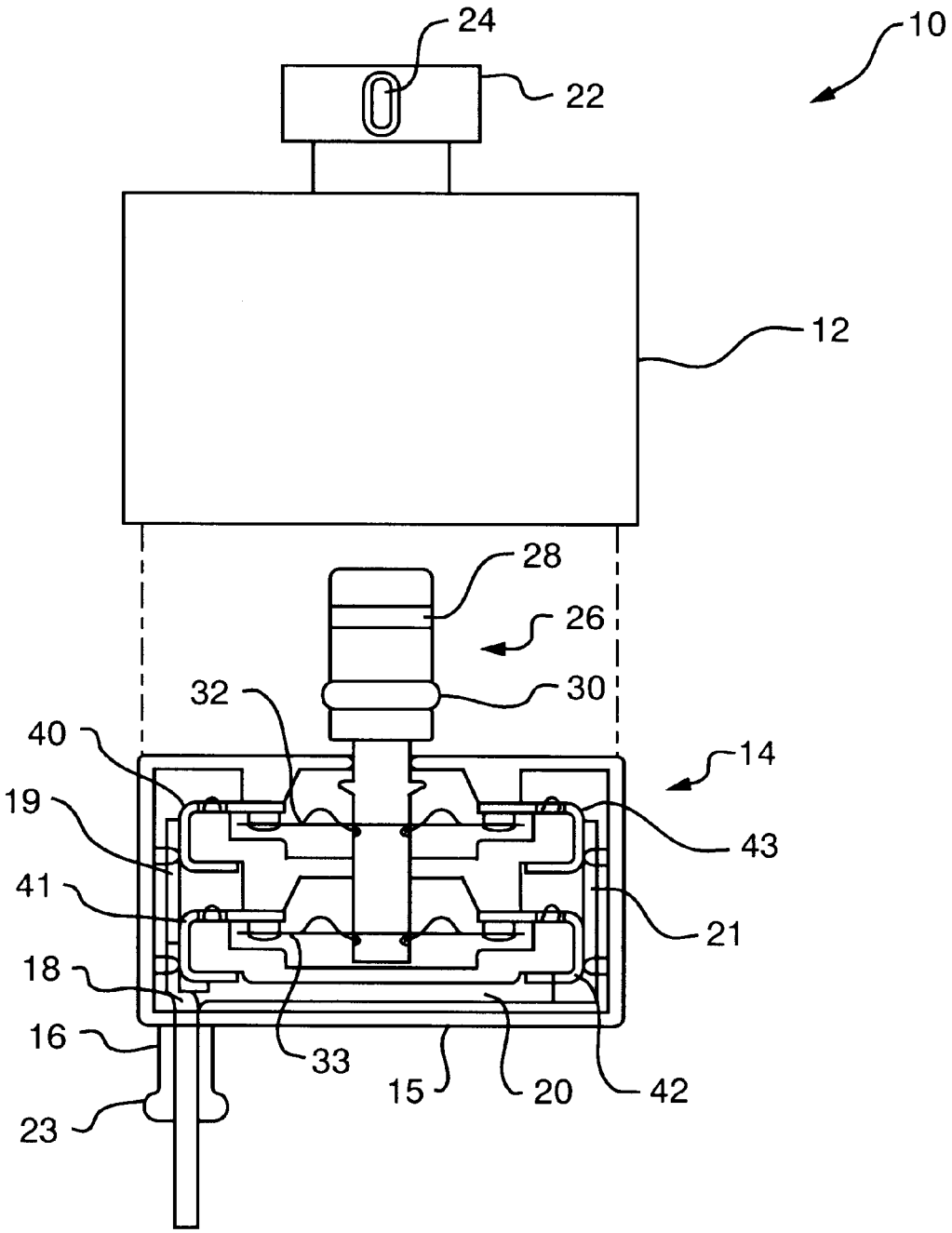
FIG. 2 is an exploded front elevational view of the switch showing an outer shell raised above the base assembly.
Figure 3:
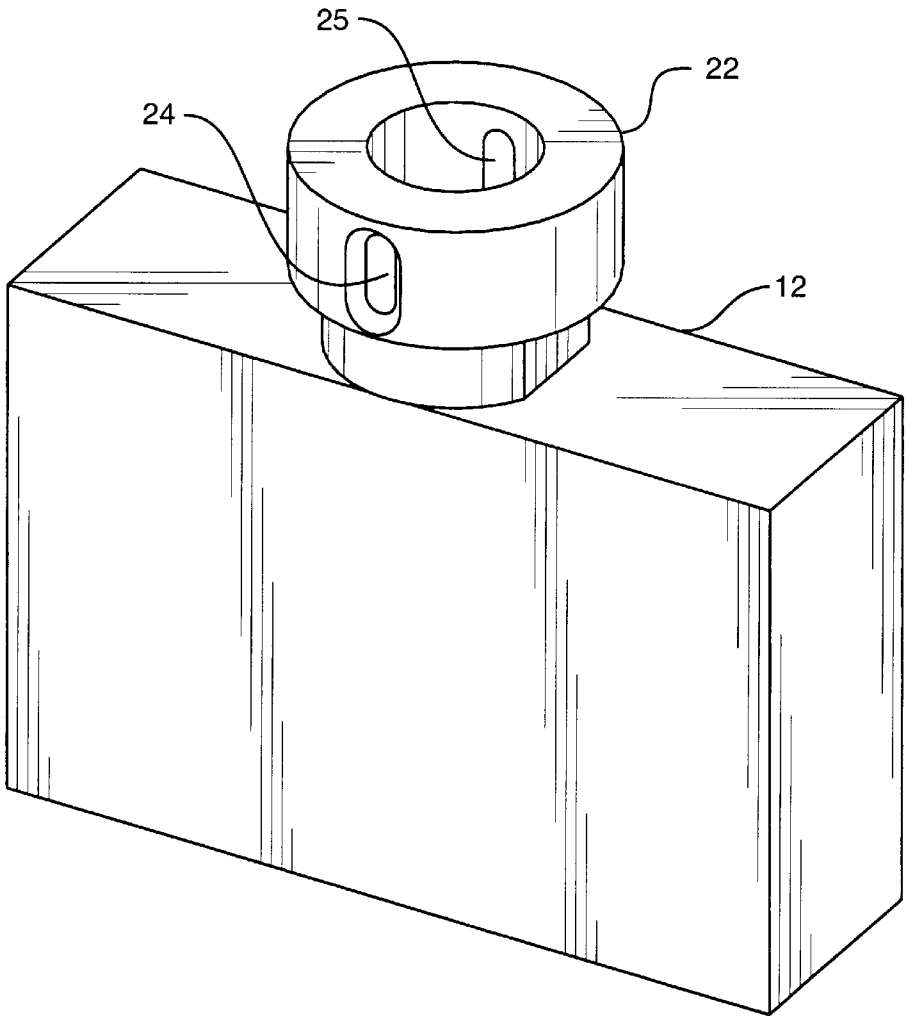
FIG. 3 is a perspective view of the shell of the manual reset switch.

Referring now to FIG. 2 and FIG. 3, FIG. 2 is an exploded front elevational view of the switch 10 showing the outer shell 12 raised exposing the base assembly 14, and FIG. 3 is a perspective view of the shell 12. The top portion of the shell comprises the actuator cap 22 having the slots 24, 25 for receiving the tool for resetting the switch 10 to a "break" position. The base assembly 14, which shows the actuator 26 depressed to the "make" position of the switch 10, comprises a molded base 15, a pair of blades 32, 33 positioned one above the other around the actuator 26, terminals 40 and 43 for contacting the contacts on the ends of blade 32, terminals 41, 42 for contacting the contacts on the ends of blade 33, and wires 18–21 attached to terminals 40–43 respectively. An O-ring 30 is positioned in a groove 29 around the upper portion of the actuator 26 for sealing the top of the switch 10 from the outside environment. An epoxy seal is placed between the bottom portion of the base assembly 14 and the lower portion of the shell 12.

Figure 4:
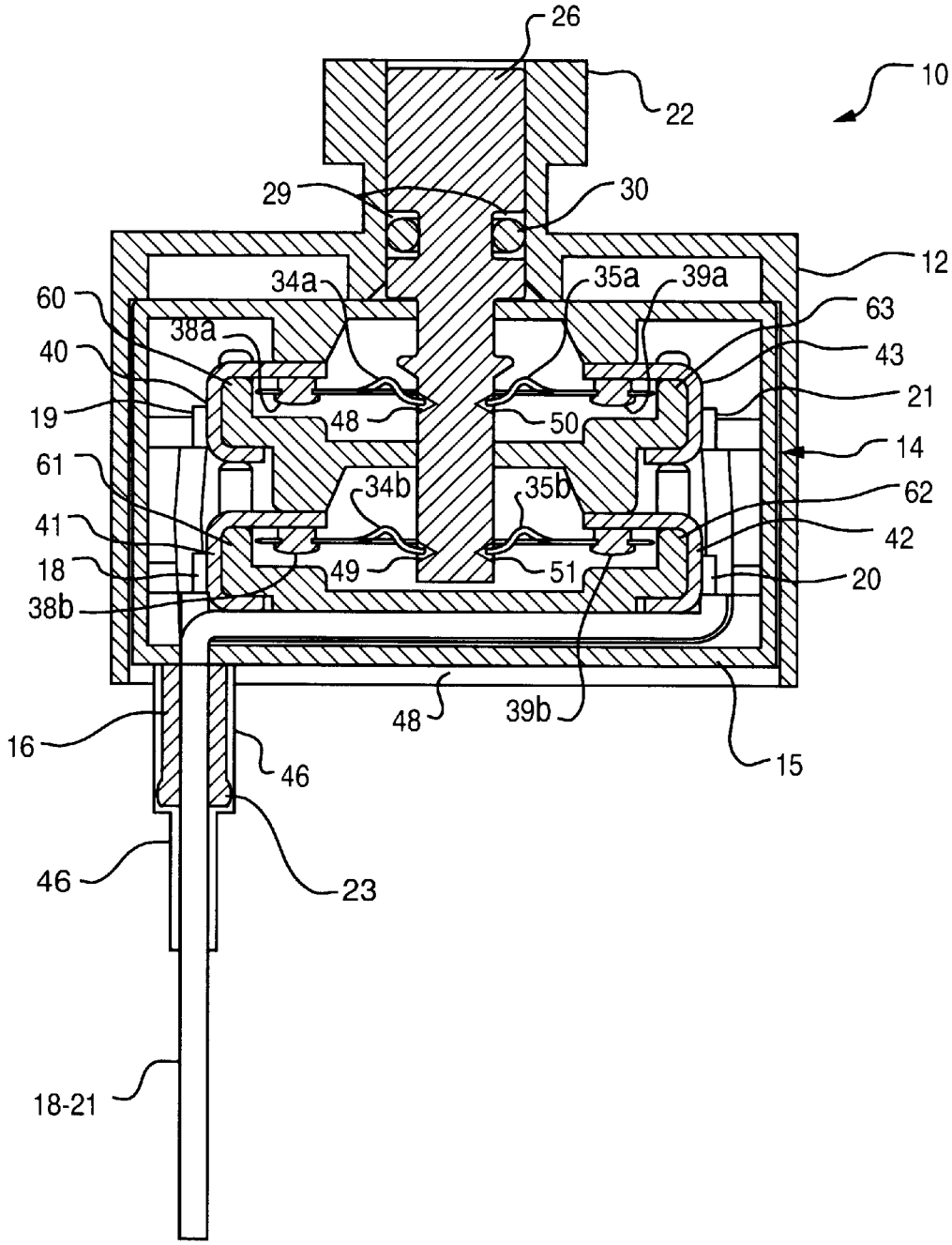
FIG. 4 is an elevational cross-section of the manual reset switch showing the switch in the "make" position.
Figure 5:
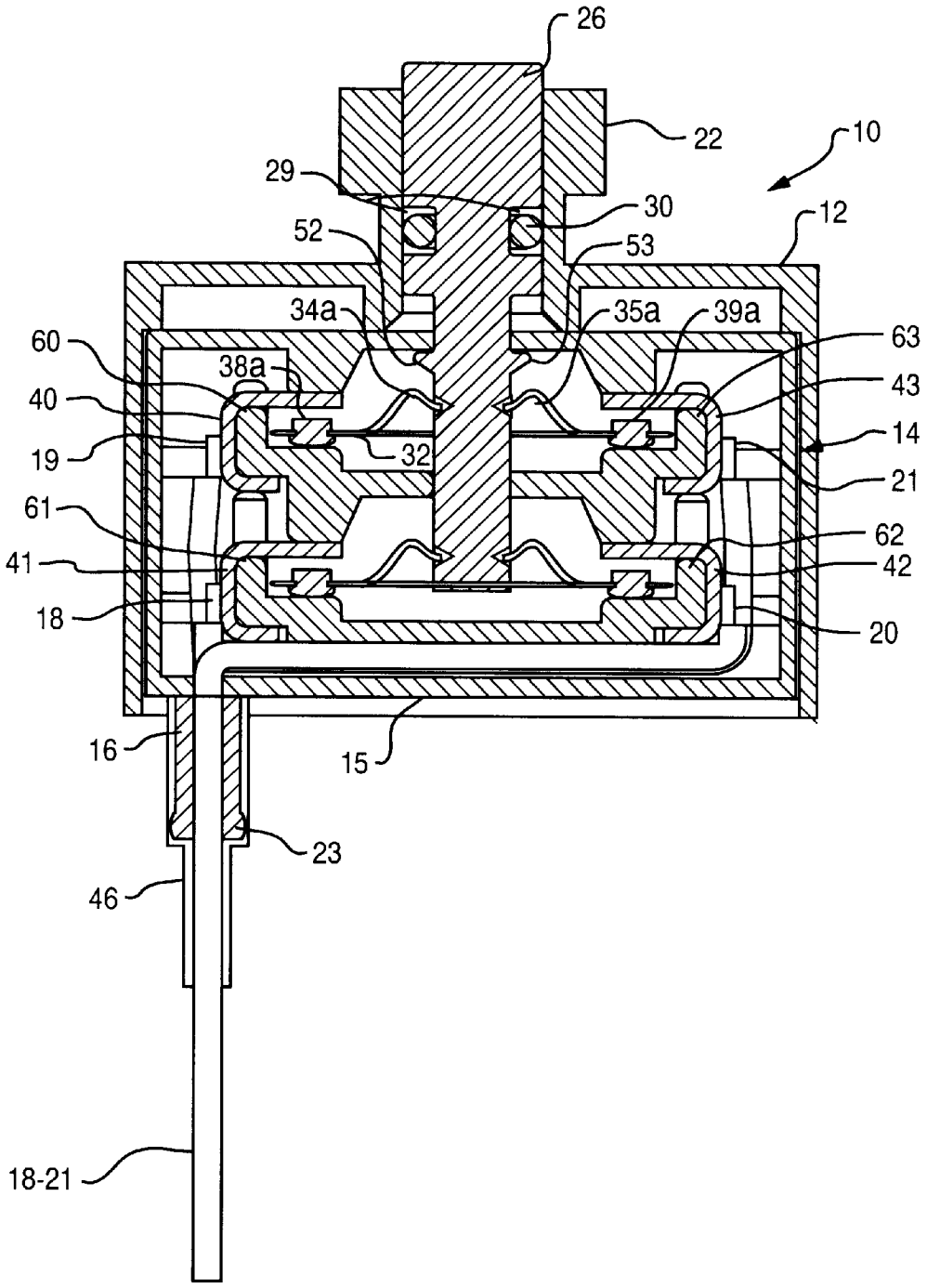
FIG. 5 is an elevational cross-section of the manual reset switch showing the switch in the "break" position.
Figure 6:
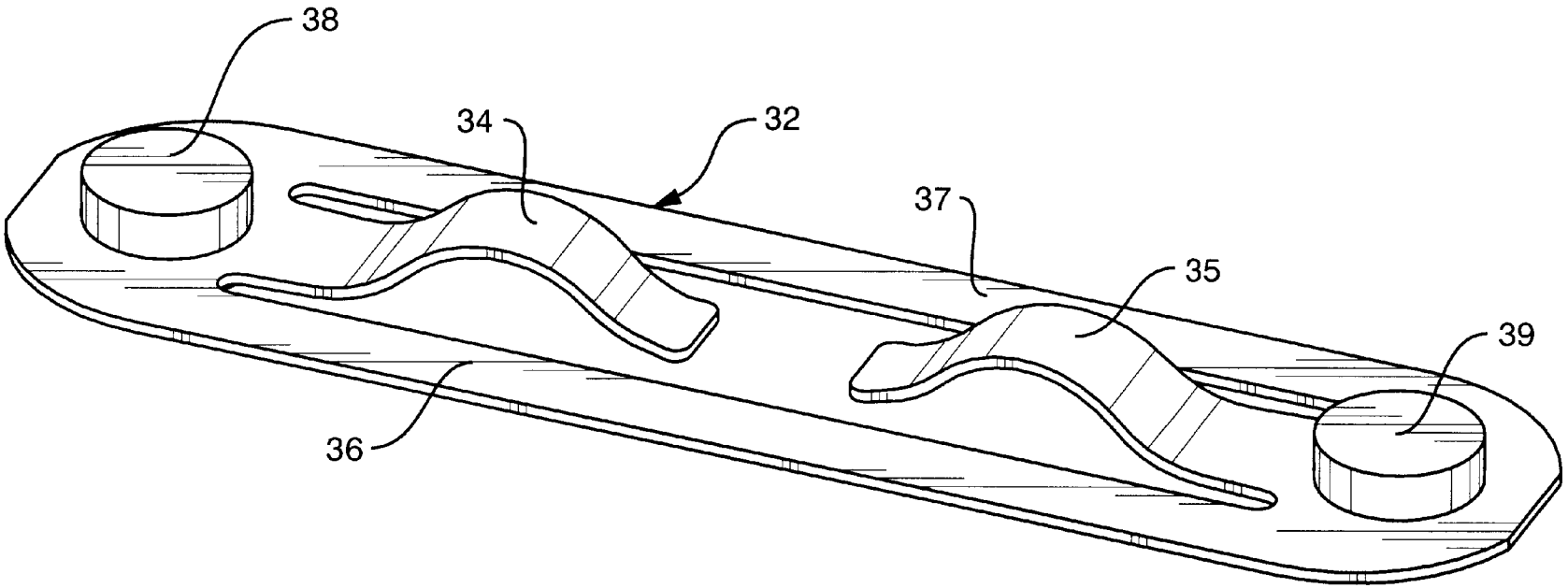
FIG. 6 is a perspective view of a blade showing contacts on each end of the blade, legs and tongues.

Referring now to FIG. 4 and FIG. 5, FIG. 4 is an elevational cross-section of the manual reset switch 10 showing the switch 10 in the "make" position. FIG. 5 is an elevational cross-section of the reset switch 10 showing the switch 10 in the "break" position. Each of the blades 32, 33 (as shown in FIG. 6) is a double break style blade. The tongues 34*a* and 35*a* of blade 32 are seated in actuator notches 48 and 50 respectively of the actuator 26 and the tongues 34*b* and 35*b* of blade 33 are seated into the actuator notches 49 and 51 respectively. The blade tongues 34 and 35 are under compression due to the size of the actuator notch depth from side to side being greater than the distance between the tongues 34 and 35. When the actuator 26 is moved so that the blade tongues 34 and 35 pass the blade legs 36 and 37 (FIG. 6), the blade legs 36, 37 and contacts 38, 39 will move in the opposite direction of the tongues 34 and 35 and maintain that position. The blades 32 and 33 work similarly in either direction.

Referring to FIG. 4 showing the switch 10 in the "make" position, the contacts 38*a* and 39*a* of the blade 32 are shown in contact with terminals 40 and 43 respectively, and contacts 38*b* and 39*b* on opposite ends of blade 33 are shown in contact with terminals 41 and 42 respectively. The four terminals 40–43 are seated on pedestals 60–63 in the base 15 along with the actuator 26 and blade/contact assemblies 32, 33. Wires 18–21 are attached to the terminals 40–43 and are routed within the base 15 so that they all exit the base 15 from the same bottom opening of the extended wire support channel 16. The blades 32 and 33 motion allows the blade contacts 38 and 39 to make connection with the terminals 40 and 43 and terminals 41 and 42, when the actuator 26 is depressed as shown in FIG. 4. The switch 10 is sealed at the bottom by placing epoxy 48 between the shell 12 and base assembly 14. The epoxy 48 may be embodied by a two-part liquid epoxy having a resin and a hardener. After mixing the two components together and dispensing the epoxy on the switch 10, the epoxy 48 is cured either in air (room temperature) or in an oven. Other equivalent sealants may be used that are commonly known in the art. Further, heat/shrink material 46 is used to encapsulate the wires 18–21 and surround the extended wire support channel 16 which has a lip 23 surrounding the lower end of the support channel 16 for providing a smooth transition of the heat/shrink material 46 extending from around the support channel 16 to around the wires 18–21 extending therefrom. The heat/shrink material may be embodied by a flexible polyolefin tubing heat/shrink material known in the art. The O-ring 30, positioned in groove 29 in the upper portion of actuator 26, seals the top of the switch 10 resulting in a manual reset switch 10 that is completely sealed from the outside environment. The O-ring may be embodied by a nitrile material having a durometer of approximately 40 on a Shore D scale or other equivalent O-rings.

Referring to FIG. 5, the actuator 26 is shown in the "break" position of switch 10. The contacts 38*a* and 39*a* of blade 32 are separated from terminals 40 and 43 respectively and the contacts 38*b* and 39*b* of blade 33 are separated from terminals 41 and 42 thereby providing no continuity through any of the circuits.

Referring now to FIG. 6, a perspective view of the blade 32 (and 33) is shown, comprising the tongues 34 and 35, legs 36 and 37 and contacts 38 and 39 on opposite ends of the blade 32. The elements of the blade 32 in FIGS. 4 and 5 are identified by the letter "a" after their reference numbers and the elements of the blade 33 are identified by the letter "b" after their reference numbers. The blades 32, 33 are made of beryllium copper and the contacts 38, 39 are made of silver.

Figure 7:
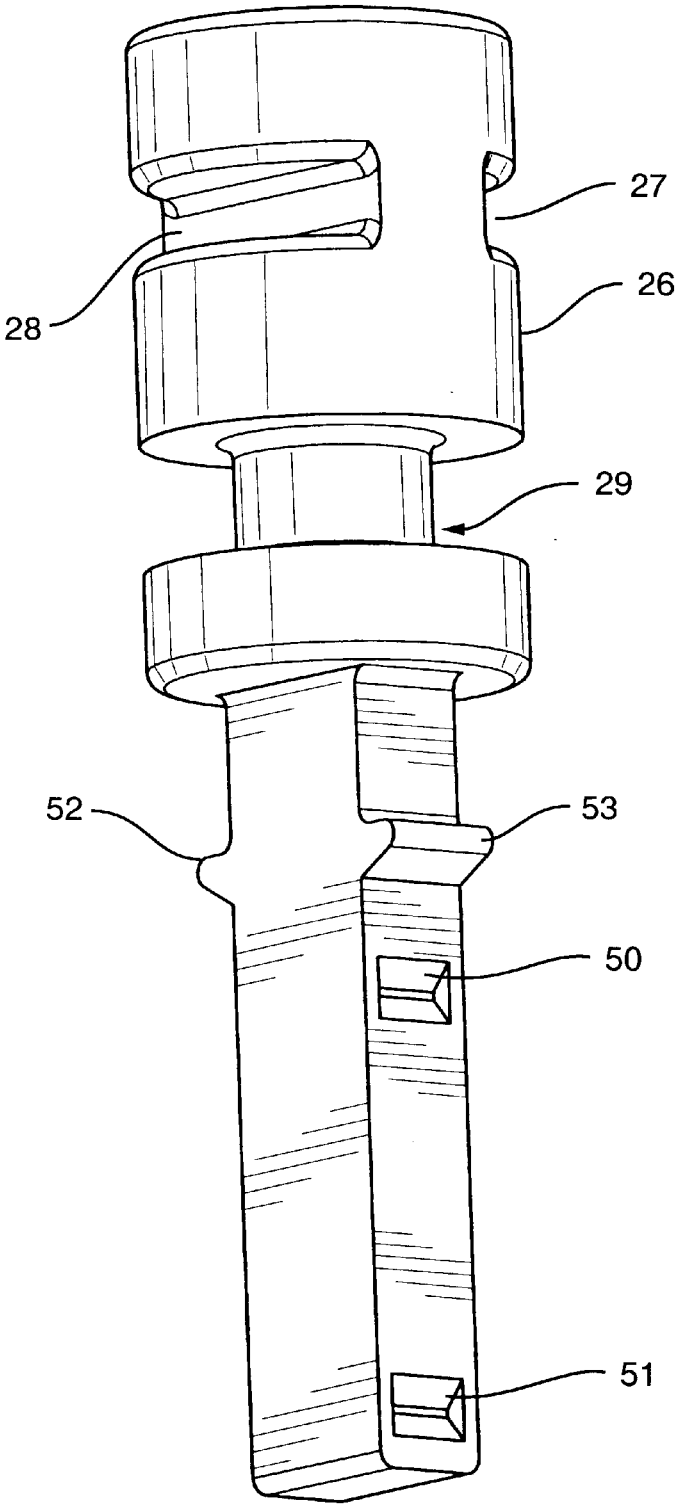
FIG. 7 is a perspective view of an actuator showing slots on two sides of a top portion for receiving a reset tool and notches on a lower portion for receiving the tongues of the blade.

Referring to FIG. 7, a perspective view of the actuator 26 is shown having slots 27 and 28 on opposite sides of the top of the actuator for receiving a tool to raise the actuator in order to reset the switch 10. The circular groove 29 receives the O-ring 30. Protrusions 52 and 53 are stops to limit the movement of the actuator 30 up to the upper inside surface of the base 15. Actuator notches 48–51 receive the tongues of blades 32, 33 as shown in FIG. 4.

Figure 8:
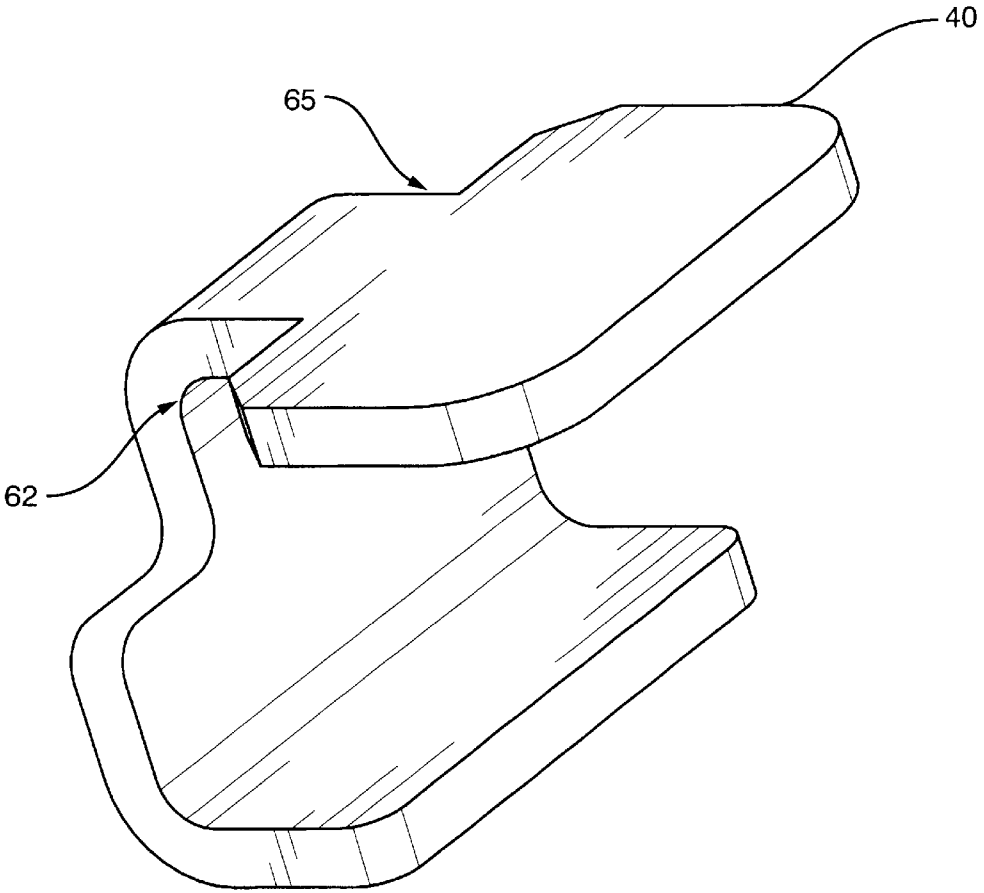
FIG. 8 is a perspective view of a terminal for insertion into the base of the switch.

Referring to FIG. 8, a perspective view of one of the terminals 40–43 is shown for insertion into the base 15 of switch 10. As described above, the terminals provide the electrical contact between the contacts 38 and 39 of the blades 32 and 33 and the wires 18, 19, 20, 21. The notches 64, 65 assist in securing the terminals 40–43 in position around the pedestals 60–63.

Figure 9:
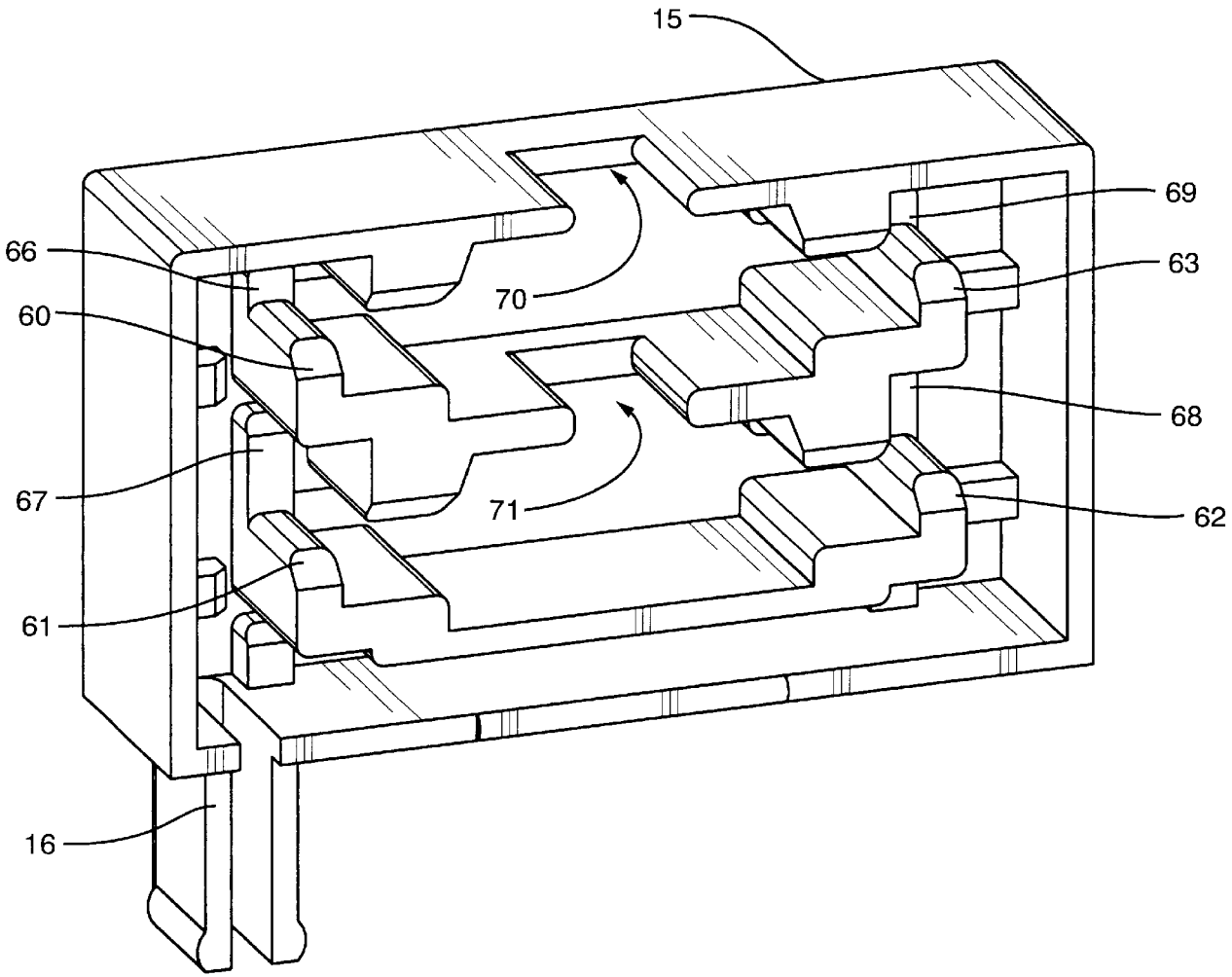
FIG. 9 is a perspective view of the inside of the base portion of the switch before assembly of an actuator and electrical parts therein.

Referring to FIG. 9, a perspective view of the inside of base 15 is shown before assembly of the actuator 26 and other electrical parts therein. The terminals 40–43 are positioned around the upper portion of pedestals 60–63 respectively and tabs 66–69 fit within one of the notches 64, 65 on each of the terminals 40–43. The actuator 26 fits in the center of the base within cut-outs 70, 71. The extended wire support 16 provides an opening for the wires 18–21 to exit the base 15. The base 15 may be embodied by molded plastic or the like known to one of ordinary skill in the art.

Figure 10:
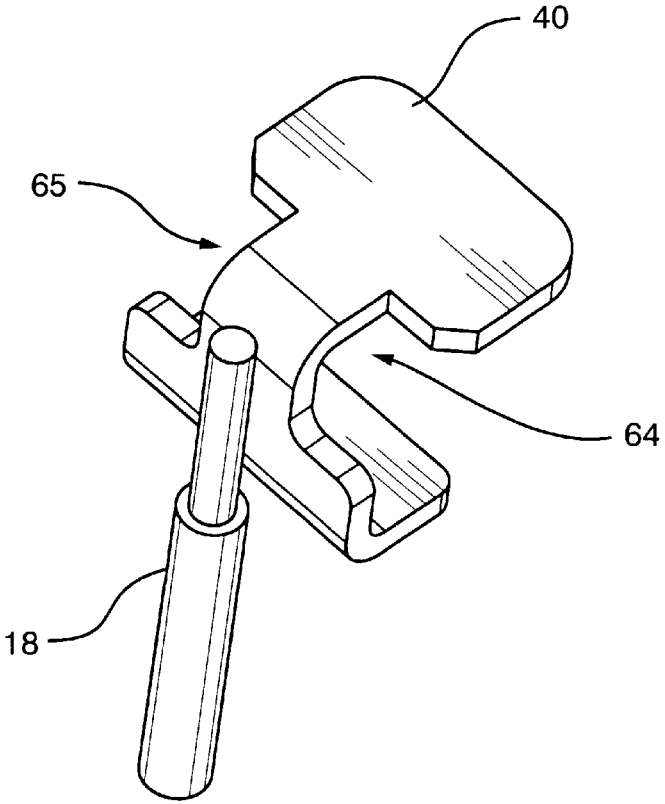
FIG. 10 is a perspective view of the terminal with a wire attached to a center section of the terminal.
Figure 11:
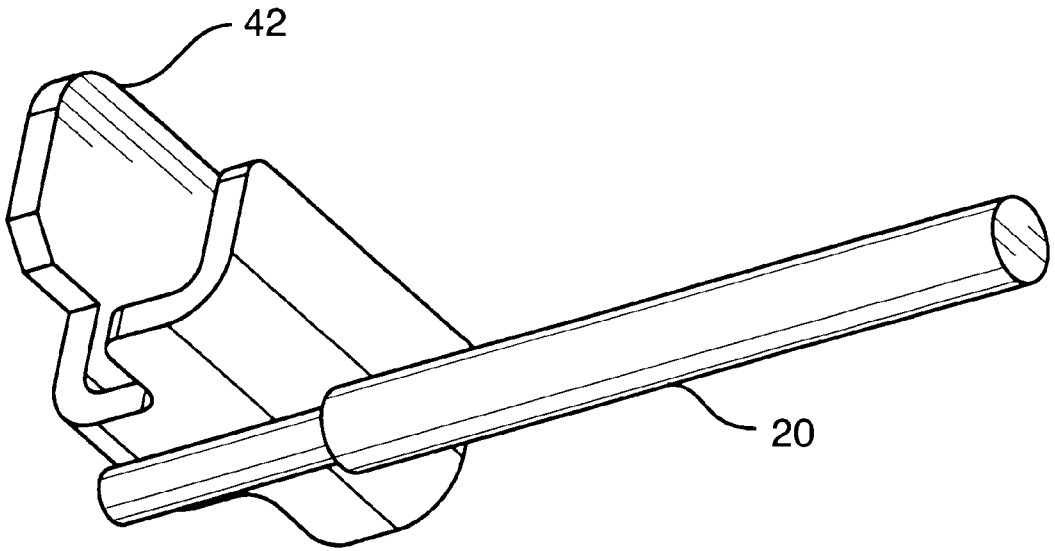
FIG. 11 is a perspective view of the terminal with a wire attached to a lower section of the terminal.

Referring to FIG. 10 and FIG. 11, FIG. 10 is a perspective view of one of the terminals 40, 41, or 43 showing one of wires 18, 19 or 21 attached to a center section thereof by soldering means or equivalent attachment means. FIG. 11 is a perspective view of the terminal 42 showing wire 20 similarly attached to a lower section thereof.

Figure 12C:
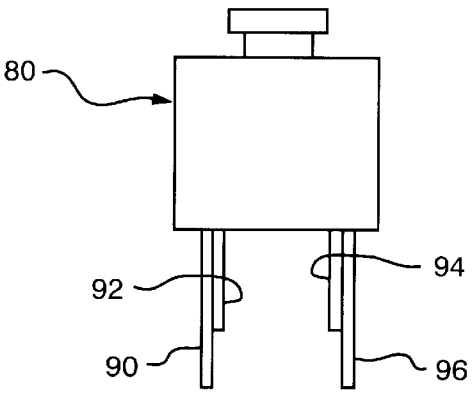
FIG. 12*a* to 12*d* show front, side, rear and opposite side elevational views of an alternate embodiment of the invention
Figure 12B:
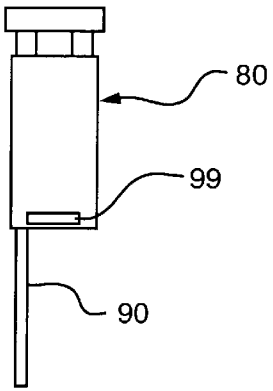
Figure 12A:
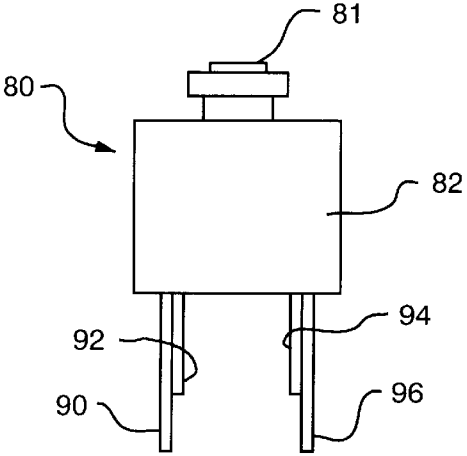
Figure 12E:
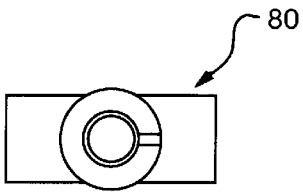
FIG. 12*e* shows a top view.
Figure 12D:
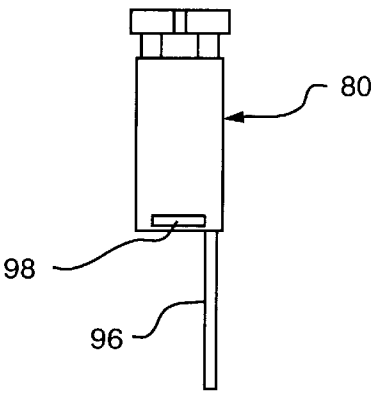

Referring now to FIG. 12*a* to 12*e* of an alternate embodiment 80 of the invention, FIG. 12*a* shows a front elevational view prior to activation with the actuator 81 extending above the top portion of an outer shell 82, FIG. 12*b* shows a first side elevational view, FIG. 12*c* shows a front elevational view after activation, FIG. 12*d* shows a second side elevational view, and FIG. 12*e* shows a top view. In this alternate embodiment the wires 90–96 extend in two pairs from the rear side of the switch 80.

Figure 13:
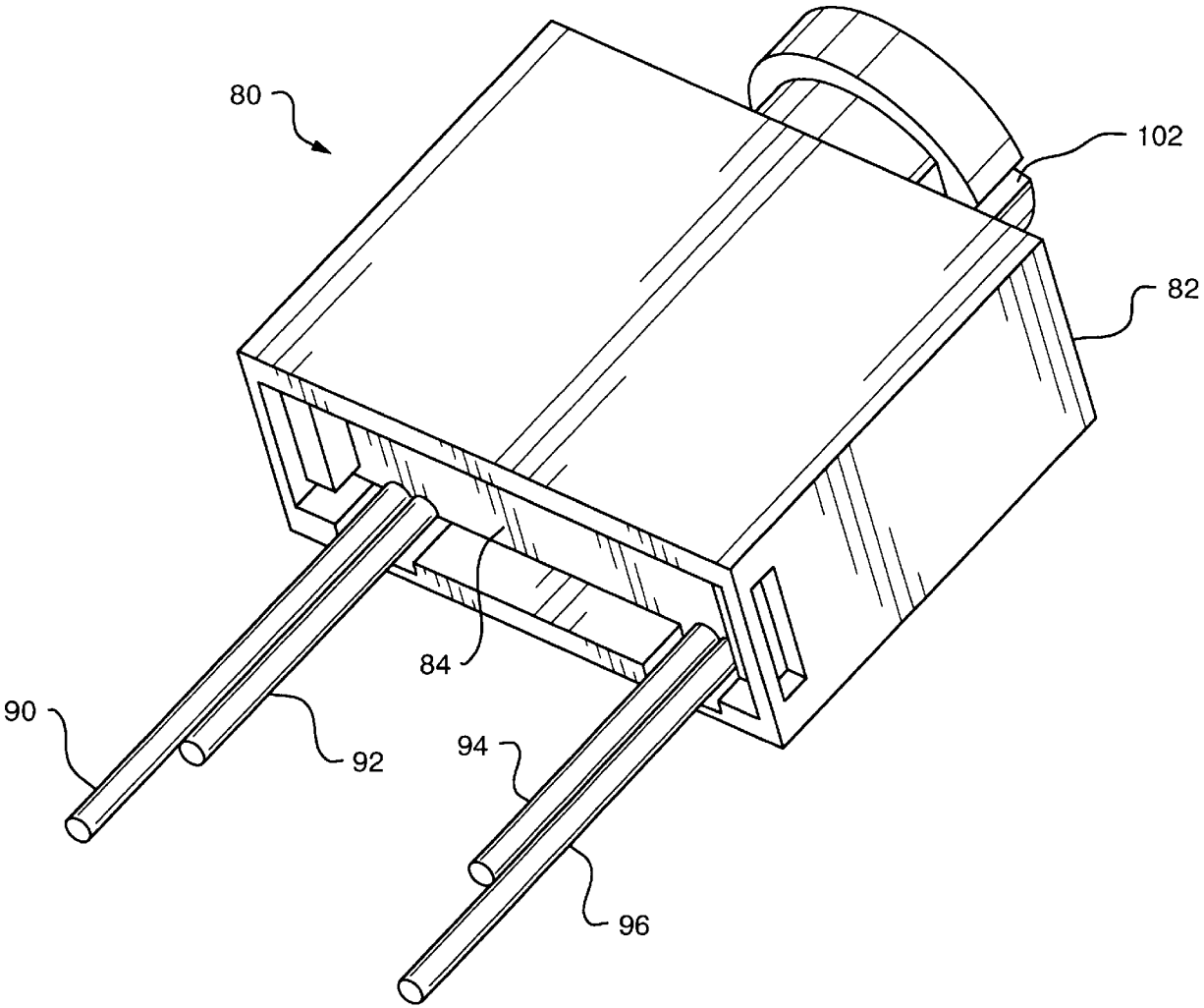
FIG. 13 is a perspective view of the alternate embodiment of the manual reset switch with wires extending from a rear side of the base assembly.

Referring to FIG. 13, the alternate embodiment of the manual reset switch 80 is shown having a shell 82, base assembly 84, wires 90–96, and slot 102 for moving an actuator 86 with a tool to a "break" position of switch 80.

Figure 14:
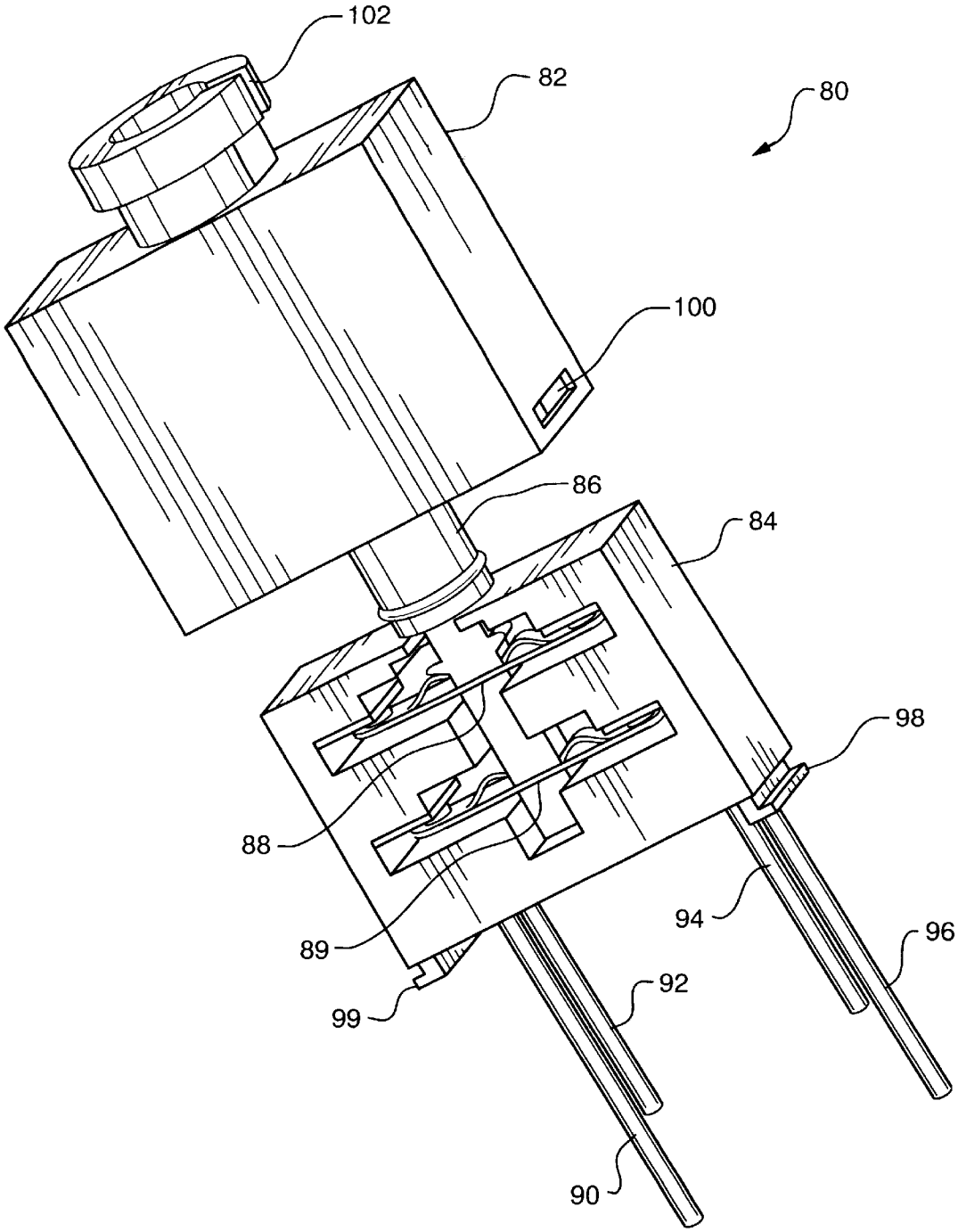
FIG. 14 is an exploded perspective view of the alternate embodiment of the manual reset switch showing the tongues of the blade positioned in the notches of the actuator.

Referring to FIG. 14, an exploded perspective view of the alternate embodiment of the manual reset switch 80 is shown. Openings 100, 101 are located in the lower portion of the side of the shell 82 for receiving latches 98 and 99 respectively which secure the shell 82 to the base assembly 84. The base 84 comprises two blades 88 and 89 and an actuator 86 with the tongues of each blade 88, 89 seated in actuator notches similar to the preferred embodiment of FIG. 4.

Figure 15:
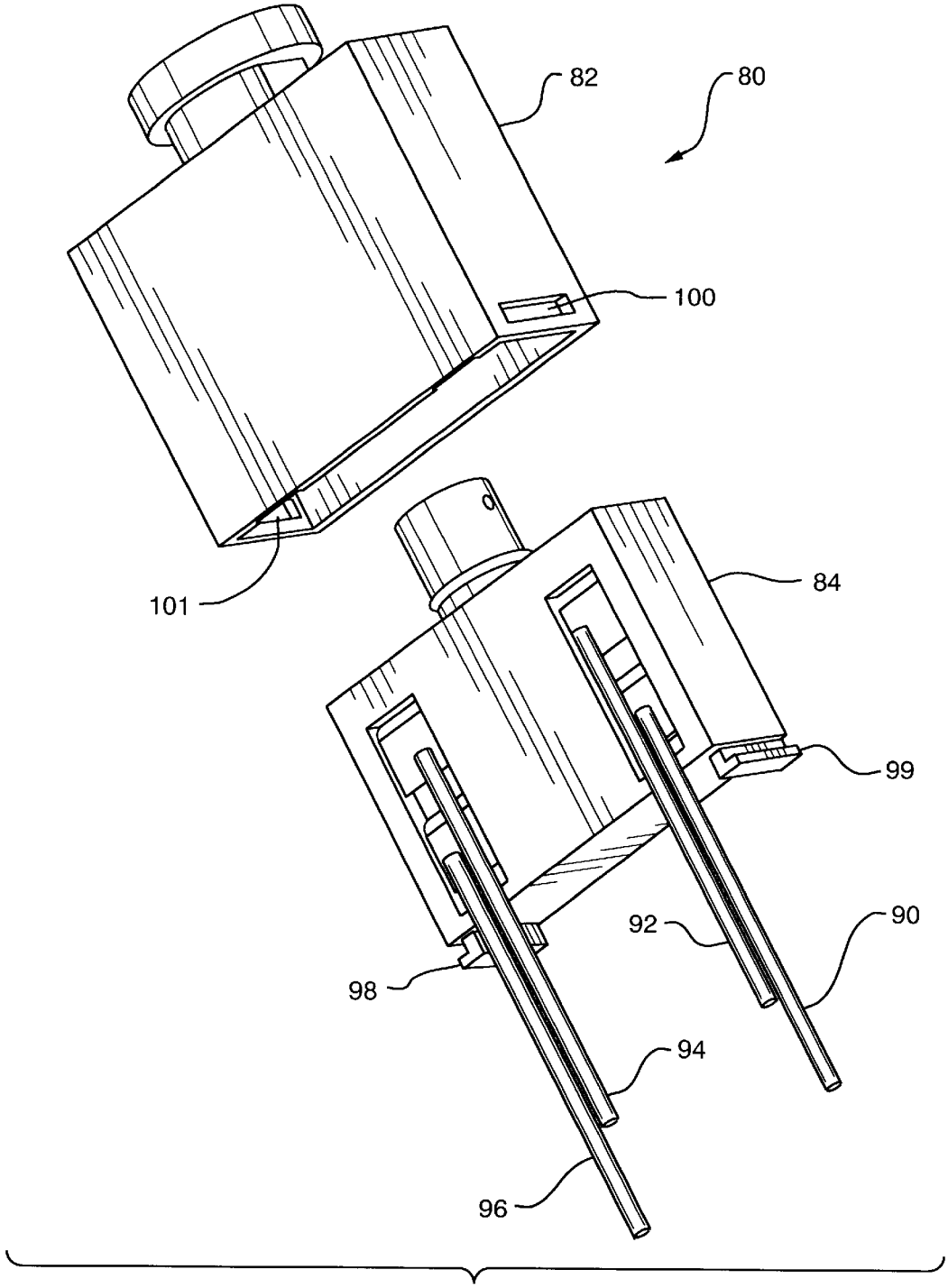
FIG. 15 is an exploded perspective view of the alternate embodiment of the manual reset switch showing the wires extending in pairs from the terminals out the bottom of the base along a rear side of the switch.

Referring now to FIG. 15, an exploded perspective view of the alternate embodiment shows the wires 90–96 extending in pairs from terminals within the base assembly 84 and out the bottom of the base assembly 84 along a rear side of the switch 80.

This invention has been disclosed in terms of certain embodiments. It will be apparent that many modifications can be made to the disclosed apparatus and method without departing from the invention. Therefore, it is the intent of the appended claims to cover all such variations and modifications as come within the true spirit and scope of this invention.

What is claimed as new and desired to be secured by Letters Patent of the United States is:

1. A double pole switch requiring use of a tool for resetting said switch comprising:

a housing having a plurality of pedestals for supporting a first pair of terminals positioned opposite each other and a second pair of terminals positioned opposite each other and spaced apart from said first pair of terminals;

an actuator positioned in an opening of said housing between said first pair of terminals and said second pair of terminals, said actuator having at least two pair of notches spaced apart from each other;

a first blade having contacts at opposite ends and a portion of said first blade in contact with an upper pair of said spaced apart notches of said actuator, said actuator passing through said first blade wherein said first blade is positioned to make electrical contact with said first pair of terminals when said switch is in a "make" position; and a second blade having contacts at opposite ends and a portion of said second blade in contact with a lower pair of said spaced apart notches of said actuator, said actuator passing through said second blade wherein said second blade is positioned to make electrical contact with said second pair of terminals when said switch is in a "make" position.

2. The double pole switch as recited in claim 1 wherein said housing comprises a base having an open channel for wires to pass through and an outer shell for enclosing said base and receiving an upper portion of said actuator which extends above said shell when said switch is in a "break" position.

3. The double pole switch as recited in claim 1 wherein said first pair of terminals are U-shaped for fitting around a pair of said opposite pedestals formed in said base.

4. The double pole switch as recited in claim 1 wherein each of said terminals of said first pair and said second pair comprises a wire electrically connected thereto and extending outside of said switch.

5. The double pole switch are recited in claim 4 wherein said base comprises a channel, protruding a predetermined distance from the bottom of said base, for receiving each wire from said terminals, said channel further comprises a lip around the open end of said channel.

6. The double pole switch as recited in claim 5 wherein said switch comprises heat shrink material for sealing off any openings at said lip of said channel.

7. The double pole switch as recited in claim 1 wherein an upper portion of said actuator comprises a groove around the circumference of said actuator for receiving an O-ring thereby sealing said upper portion of said switch when said base is inserted within an outer shell.

8. The double pole switch as recited in claim 7 wherein said switch comprises means for sealing an opening between a lower portion of said base and said outer shell.

9. The double pole switch as recited in claim 8 wherein said switch comprises heat/switch material around said base and wires passing through said base.

10. The double pole switch as recited in claim 1 wherein said top portion of said actuator comprises a slot for insertion of said tool for moving said actuator from said "make" position to a "break" position.

11. The double pole switch as recited in claim 10 wherein said top portion of an outer shell of said switch comprises an opening to enable insertion of said tool into said slot of said actuator.

12. The double pole switch as recited in claim 1 wherein said portion of said first blade in contact with an upper pair of spaced apart notches of said actuator comprises a pair of tongues.

13. The double pole switch as recited in claim 12 wherein said portion of said second blade in contact with a lower pair of said spaced apart notches of said actuator comprises a pair of tongues.

14. A sealed, manual reset, double pole switch comprising:

a housing having a base portion and an outer shell portion;

a pair of spaced apart parallel blades positioned within said base having contacts on opposite ends;

an actuator positioned through said parallel blades and perpendicular thereto;

at least four terminals mounted on pedestals within said base portion, said terminals making electrical contact with said blade contacts when said switch is in a "make" position and said actuator extends above a top portion of said outer shell;

said actuator comprises a groove around the circumference of said actuator for receiving an O-ring thereby sealing said upper portion of said switch;

said switch comprises means for sealing an opening between a lower portion of said base and said outer shell;

said base comprises a channel for wires to pass through and connect to said terminals and heat shrink material applied around an end of said channel and around said wires; and a slot provided in the top portion of said outer shell and said actuator for insertion of a tool to move said actuator from said "make" position to a "break" position in order to reset said switch.

15. The sealed, manual reset, double pole switch as recited in claim 14 wherein said tool moves said actuator to extend above a top portion of said outer shell.

16. A method of providing a double throw switch requiring a tool to reset the switch comprises the steps of:

providing a housing having a plurality of pedestals to support a first pair of terminals positioned opposite each other within said housing and to support a second pair of terminals positioned opposite each other and spaced apart from said first pair of terminals within said housing;

positioning an actuator within an opening in said housing between said first pair of terminals and said second pair of terminals, said actuator having at least two pairs of notches spaced apart from each other;

connecting said actuator within a first blade by positioning tongues of said first blade within a first pair of said notches of said actuator, said first blade having electrical contacts at opposite ends for making contact with said first pair of terminals when said switch is in a "make" position; and connecting said actuator within a second blade by positioning tongues of said second blade within a second pair of said notches of said actuator, said second blade having electrical contacts at opposite ends for making contact with said second pair of terminals when said switch is in a "make" position.

17. The method as recited in claim 15 wherein said method comprises the step of sealing an upper portion of said switch by providing a groove around the circumference of said actuator for receiving an O-ring.

18. The method as recited in claim 17 wherein said method comprises the step of sealing an opening between a lower position of said base and said outer shell.

19. The method as recited in claim 18 wherein said method comprises the step of applying heat shrink material around a channel having wires passing therethrough for sealing any openings at the entrance to said channel.

20. The method as recited in claim 16 wherein said method comprises the step of providing a slot in a top portion of said actuator and an outer shell for inserting said tool to move said actuator from said "make" position to a "break" position.

* * * * *